United States Patent [19]

Takahashi

[11] Patent Number: 4,492,200

[45] Date of Patent: Jan. 8, 1985

[54] FUEL PUMPING APPARATUS

[75] Inventor: Ikuo Takahashi, Katsuta, Japan

[73] Assignee: Hitachi, Ltd., Tokyo, Japan

[21] Appl. No.: 494,446

[22] Filed: May 13, 1983

[30] Foreign Application Priority Data

May 14, 1982 [JP] Japan ..... 57-79858

[51] Int. Cl.[3] ..... F02M 41/06

[52] U.S. Cl. ..... 123/450; 123/501; 417/462

[58] Field of Search ..... 123/450, 500, 501, 502; 417/462

[56] References Cited

U.S. PATENT DOCUMENTS

| | | | |
|---|---|---|---|
| 3,035,523 | 5/1962 | Kemp et al. | 123/450 |
| 3,107,661 | 10/1963 | Kemp | 123/450 |
| 3,263,614 | 8/1966 | Kemp | 123/450 |
| 3,427,979 | 2/1969 | Kemp | 123/450 |
| 3,500,749 | 3/1970 | Kemp et al. | 123/450 |
| 4,401,076 | 8/1983 | Sano et al. | 123/501 |

FOREIGN PATENT DOCUMENTS

| | | | |
|---|---|---|---|
| 246055 | 12/1960 | Australia | 123/450 |

*Primary Examiner*—Magdalen Y. C. Moy

*Attorney, Agent, or Firm*—Antonelli, Terry & Wands

[57] ABSTRACT

A fuel pump for internal combustion engine has a working chamber which is divided into two chamber sections by a shuttle disposed therein, and a pumping chamber independent from the working chamber. After a delivery of a fuel into one of the chamber sections and the pumping chamber, the one chamber section is brought into communication with an injection nozzle and the pumping chamber is made to communicate with the other chamber section. Then, the volume of the pumping chamber is decreased and the fuel is pumped into the other chamber section from the pumping chamber, so that the fuel in the one chamber section is pumped into the injector nozzle through the shuttle by means of the fuel contained in the other chamber section.

6 Claims, 5 Drawing Figures

FUEL PUMPING APPARATUS

BACKGROUND OF THE INVENTION

The present invention relates to a fuel pump for internal combustion engines and, more particularly, to a fuel pump suitable for use in diesel engines.

A fuel pump of the aforementioned type includes a working chamber divided by a shuttle member into two working chamber sections. A fuel to be injected is delivered to one of the working chamber sections, while the other working chamber section receives therein a fuel which pushes the shuttle member to pump the fuel in the first-mentioned working chamber section to an injection nozzle. In such a fuel pump, the supply of the fuel to one working chamber section has to overcome the force produced by the fuel residing in the other working chamber section. Thus, the fuel pressures in both working chamber sections interfere with each other through the shuttle member, so that fuel is not introduced into the working chamber section at the predetermined rate and/or a fuel is not pumped out at the predetermined rate.

Accordingly, an object of the present invention is to provide a fuel pump capable of timely pumping a fuel at a predetermined rate to each injection nozzle of an internal combustion engine to overcome the problems encountered in the prior art.

The features and advantages of the present invention will become apparent from the following description of a preferred embodiment in conjunction with the accompanying drawings.

DETAILED DESCRIPTION

Figure 1:
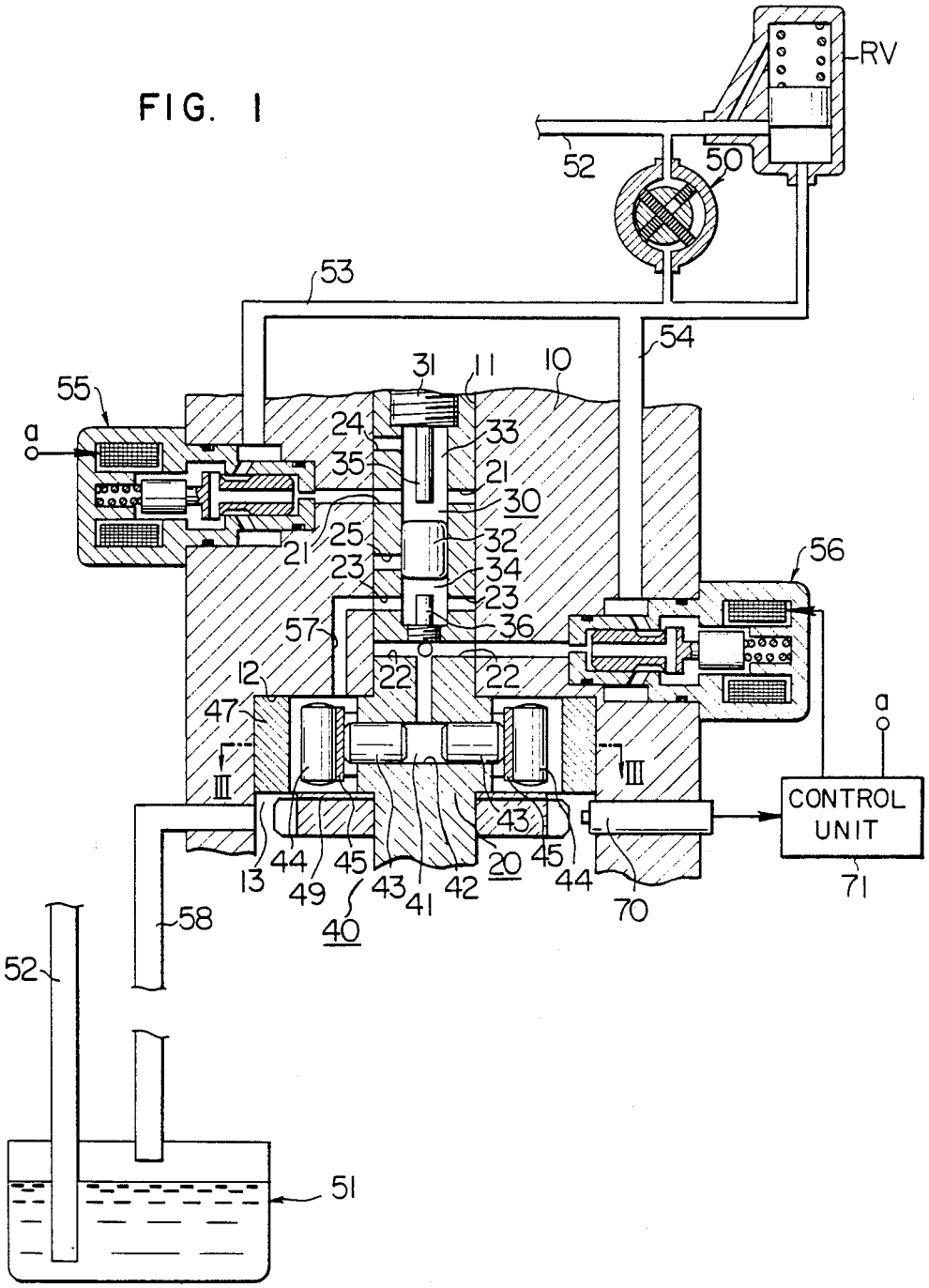
FIG. 1 is a fragmentary sectional view of an embodiment of the fuel pump in accordance with the present invention, in the state in which a fuel to be pumped into an injection nozzle is being drawn into the fuel pump.

Referring first to FIG. 1, a fuel pump for a diesel engine having four cylinders, includes a main body 10 having a stepped bore 11 therein, with the stepped bore 11 rotatably receiving a rotor 20 adapted to be rotated in synchronism with the diesel engine (not shown). The rotor 20 is provided with a working chamber 30 defined by a bore having a bottom and a threaded plug 31. A shuttle 32 is slidably disposed in a liquid tight manner in the working chamber 30 so as to divide the latter into two chamber sections 33 and 34.

Figure 3:
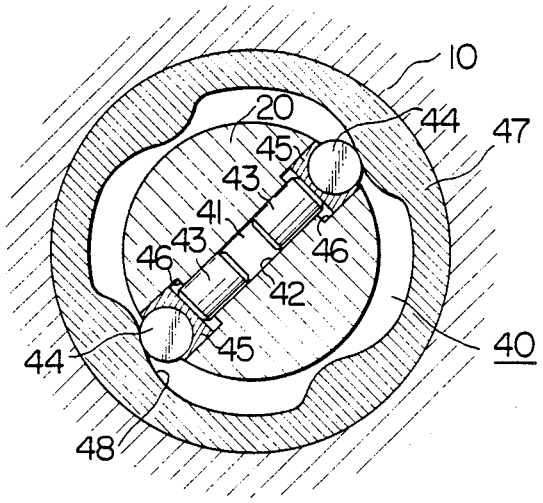
FIG. 3 is a sectional view of a part of the fuel pump taken along the line III—III of FIG. 1.

A pumping means generally designated by the reference numeral 40 includes a diametrical through bore 42 formed in the rotor 20 and a pumping chamber 41 defined by a pair of plungers 43 and 43 slidably received in the bore 42. As shown in FIG. 3, each plunger 43 comes into contact with a roller 44 through a liner 45 slidably received in an axial groove 46 formed in a peripheral outer portion of the rotor 20. These members are accomodated by an annular ring 47 which is fixed to a shoulder portion 12 in the stepped bore 11. The annular ring 47 is provided on its inner peripheral surface with a cam surface 48 which, during the rotation of the rotor 20, controls the radial movement of the pair of plungers 43 and 43 to vary a volume of the pumping chamber 41. An annular plate 49 prevents the roller 44 from dropping out.

The rotor 20 is provided with three passage section groups, with each group having four equiangular-spaced connecting passage sections which extend on one of three planes which are parallel to one another and spaced in the axial direction. More specifically, a first passage section group has four connecting passage sections 21 each of which opens at one end to one of working chamber sections or first working chamber section 33 and at the other end to the outer peripheral surface of the rotor 20. A second passage section group has four connecting passage sections 22 each of which opens at one end to the pumping chamber 41 and at the other end to the outer peripheral surface of the rotor 20. The third passage section group has four connecting passage sections 23 each of which opens at one end to the other working chamber section or second working chamber section 34 and at the other end to the outer peripheral surface of the rotor 20. The connecting passage sections of each passage section group are in alignment with corresponding connecting passage sections of other passage section groups in the axial direction of the rotor. It is to be noted here that the number of the connecting passage sections in each passage section group corresponds to the number of cylinders of the diesel engine. Namely, it should be understood that when the fuel pump according to the present invention is applied to an internal combustion engine having six cylinders, each passage section group must have six connecting passage sections. A main pump 50 is adapted to be driven by the diesel engine, with the main pump 50 delivering a fuel from a reservoir 51 to a first and a second main passage sections 53 and 54 through a main fuel passage 52. A filter means (not shown) and a regulator valve RV are disposed in a portion of the main fuel passage 52 between the main pump 50 and the reservoir 51.

A first main passage section 53 extends from the main pump 50 to an opening formed in the inner peripheral surface of the main body 10 for alignment with the opening of the connecting passage section 21. When the main passage section 53 is aligned with the connecting passage section 21, a first fuel passage is completed. A solenoid valve generally designated by the reference numeral 55 is disposed in the main passage section 53 for metering a fuel to be delivered to the first working chamber section 33 through the first fuel passage.

A second main passage section 54 extends from the main pump 50 to an opening formed in the inner peripheral surface of the main body 10 for alignment with the opening of the connecting passage section 22. When the main passage section 54 is aligned with the connecting passage section 22, a second fuel passage is completed. A solenoid valve generally designated by the reference numeral 56 is disposed in the main passage section 54 for metering a fuel to be delivered into the pumping chamber 41 through the second fuel passage.

A third fuel passage has the connecting passage section 23 and a main passage section which extends from an opening formed in the inner peripheral surface of the main body 10 for alignment with the opening of the connecting passage section 23 to the reservoir 51. The main passage section consists of a sub passage section 57 which extends from the above-mentioned opening to a space 13 in the bore 11, the space 13 and a sub passage section 58 which extends from the space 13 to the reservoir 51.

A fuel pump having the construction described hereinabove operates as follows.

When the rotor 20 is rotated in synchronism with the operation of the engine and the main passage section 53 becomes in alignment with the connecting passage section 21, as shown in FIG. 1, this alignment is sensed by a sensor 70 and a signal is delivered into a control unit 71. Upon receipt of this signal, the control unit 71 delivers command signals to both solenoid valves 55 and 56 so as to open these valves. In this state, the main passage section 54 is adapted to become in alignment with the connecting passage section 22 as well as the sub passage section 57 also adapted to become in alignment with the connecting passage section 23. A predetermined amount of pressurized fuel is introduced into the first working chamber section 33 from the main pump 50 through the first fuel passage. Since the second working chamber section 34 is in communication with the reservoir 51, i.e. atmosphere, the shuttle 32 is displaced readily, so that the predetermined amount of fuel is introduced smoothly into the first working chamber section 33.

On the other hand, a predetermined amount of pressurized fuel is introduced from the main pump 50 into the pumping chamber 41 through the second fuel passage, so that the pair of plungers 43 and 43 are moved radially away from each other. When a predetermined time elapses, the control unit delivers command signals to the solenoid valves 55 and 56 so as to close these valves.

Figure 2:
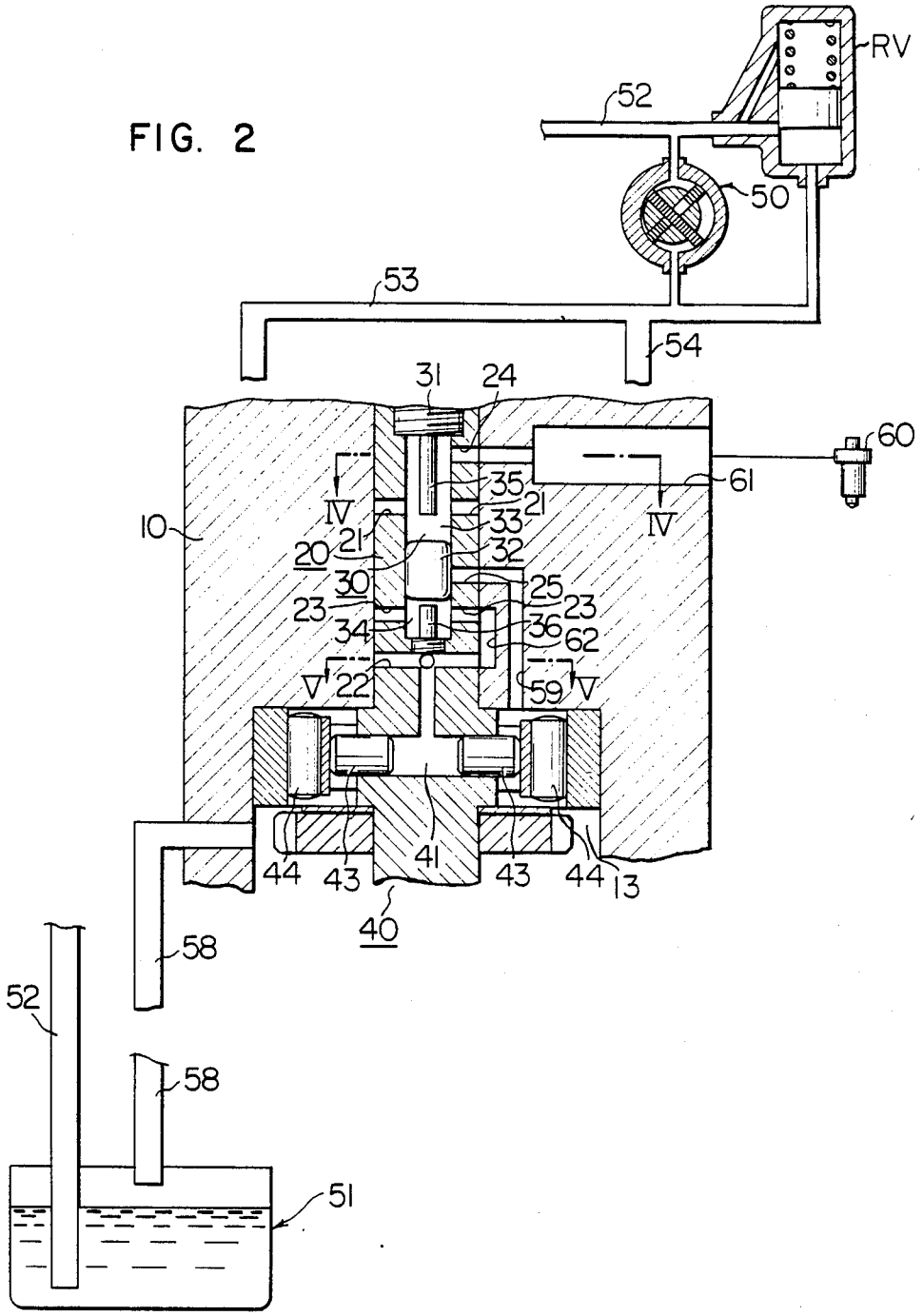
FIG. 2 is a fragmentary sectional view of the fuel pump shown in FIG. 1, in the state in which the fuel is being pumped into the injection nozzle.

The first, second and third fuel passages are respectively interrupted by the subsequent rotation of the rotor 20, so that the fuel pump takes a next state shown in FIG. 2.

In the state shown in FIG. 2, the first working chamber section 33 is communicated with an injection nozzle 60 through a fourth fuel passage which is constituted by a connecting passage section 24 opening at one end to the first working chamber section 33 and at the other end to the outer peripheral surface of the rotor 20, and a main passage section 61 opening in a portion of the inner peripheral surface of the main body 10 engageable with the other end opening of the connecting passage section 24 and extending at the other end to the injection nozzle 60. An interconnecting groove 62 is formed in the inner peripheral surface of the main body 10 so as to interconnect the connecting passage section 22 of the second passage section group and the connecting passage section 23 of the third passage section group. Therefore, a fifth fuel passage extending between the pumping chamber 41 and the second working chamber section 34 is completed.

In order that both communications between the first working chamber section 33 and the injection nozzle 60, and between the connecting passage sections 22 and 23 are established simultaneously, the connecting passage section 24 is formed in a portion of the rotor adapted be aligned with one connecting passage section. As will be seen from FIG. 3, the annular ring 47 is so disposed that when both communications are established, the pair of rollers 44 of the pumping means 40 contact with the radially inward projections on the cam surfaces 48 of the annular ring 47 and the pair of plungers 43 of the annular ring 47 and the pair of plungers 43 and 43 are displaced radially inwardly to reduce the volume of the pumping chamber 41.

Figure 4:
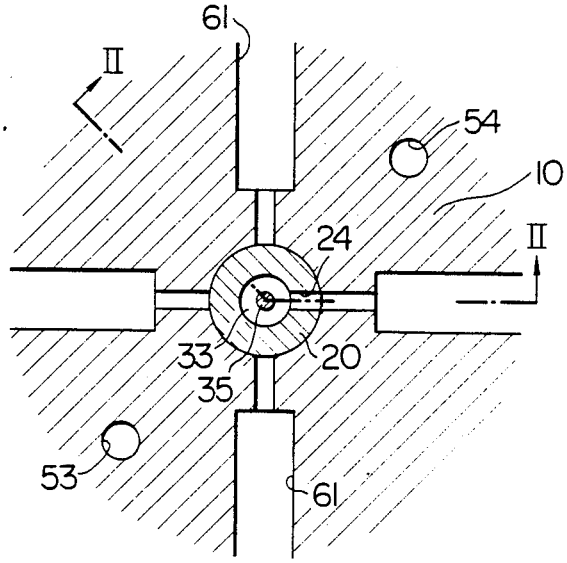
FIG. 4 is a sectional view of a part of the fuel pump taken along line IV—IV of FIG. 2.
Figure 5:
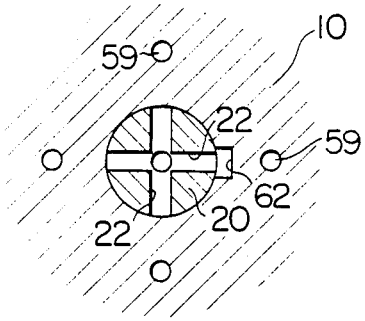
FIG. 5 is a sectional view of a part of the fuel pump taken along the line V—V of FIG. 2.

In this state, the fuel contained in the pumping chamber 41 is forced out therefrom to the second working chamber section 34 through the fifth fuel passage chamber section 34 by means of the volume reduction of the pumping chamber 41. Consequently, the shuttle 32 is displaced and the fuel in the first working chamber section 33 is pumped out through the fourth fuel passage to the injection nozzle 60, i.e. a lower portion, and is injected from the latter. As will be best seen from FIG. 4, four main passage sections 61 is arranged in equiangular intervals, so that fuel is pumped to the injection nozzles successively through the respective main passage sections 61.

The fuel pump further has an overflow passage constituted by a connecting passage section 25 opening at one end to the working chamber 30 and at the other end to the outer peripheral surface of the rotor 20, an overflow passage section 59 opening at one end to the space 13 and at the other end to a portion of the inner peripheral surface of the main body 10 engageable with the other end opening of the connecting passage section 25, a space 13 and a sub passage section 58. As the shuttle 32 is displaced beyond one end opening of the connecting passage section 25 by means of the fuel from the pumping chamber 41, the fuel is returned to the reservoir 51 through the overflow passage, so that the shuttle 32 is held at this position. The projections 35 and 36 projecting into the working chamber 30 serve as means for a proper initial positioning of the shuttle 32 thereby to prevent the interruption of the communication between the first fuel passage and the first working chamber section 33 or the interruption of the communication between the second fuel passage and the second working chamber section 34 which may be caused due to an excessive displacement of the shuttle 32 is an initial condition.

Thus, according to the present invention, the two sorts of communications: namely, the communications between the first fuel passage and the first working chamber section 33, between the second fuel passage and the pumping chamber 41, and between the third fuel passage and the second working chamber section 34; and the communications between the fourth fuel passage and the first working chamber section 33 and between the fifth fuel passage and pumping chamber 41; are established alternatingly in accordance with the rotation of the rotor 20, so that the fuel is pumped to four injection nozzles successively.

Furthermore, in the present invention, the ratio between the number of the main passage section and the number of connecting passage sections in each of the first, second and third fuel passages is selected to be 1:4. It will be clear to those skilled in the art that the same advantage is attained even if this ratio is selected to be 4:1.

In the operation of the fuel pump of the present invention, the following steps are taken sequentially in accordance with the rotation of the rotor:

(a) Two spaces which interfere with each other through a partition means are prepared;

(b) Pressurized fuel is introduced into one of the spaces and an additional space which does interfere with neither of two spaces, while the other space is opened;

(c) The spaces are disconnected from other members;

(d) The one of the spaces is brought into communication with the injection nozzle while the additional space is communicated with the other space;

(e) The volume of the additional space is decreased, so that the fuel in the additional space is forced out into the other space;

(f) The fuel from the additional space pumps the fuel in the one of the spaces through the partition means into an injection nozzle; and (g) The spaces are disconnected from the other members.

In the fuel pump of the present invention, the rate or amount of fuel to be injected is determined by the amount of fuel contained in the space for communication with the injection nozzle, i.e. the first working chamber section 33 while the timing of injection is determined by the amount of fuel contained in the pumping chamber 41.

Therefore, as will be clearly understood also from the foregoing description, the amount of fuel to be injected and the amount of fuel pertaining to the injection timing are determined independently without being interfered by each other. In addition, it is possible to easily control the timing of injection of the fuel to be injected.

What is claimed is:

1. A fuel pump for an internal combustion engine, the fuel pump comprising:

a main body having a bore therein;

a rotor housed within said bore and adapted to be rotated in synchronism with a rotation of said engine;

a working chamber formed in said rotor;

a shuttle member disposed slidably within said working chamber to divide said working chamber into a first and second working chamber section;

a pumping means having a pumping chamber, a volume of said pumping chamber being varied in accordance with a rotation of the engine;

a first fuel passage in which a first metering means is disposed for metering a pressurized fuel to be delivered into said first working chamber section through said first fuel passage;

a second fuel passage in which a second fuel metering means is disposed for metering a pressurized fuel to be delivered to said second working chamber section through said second fuel passage;

a third fuel passage adapted to communicate said second working chamber section with an atmosphere;

a fourth fuel passage adapted to communicate said first working chamber section with an injection nozzle; and a fifth fuel passage adapted to communicate said pumping chamber with said second working chamber section;

wherein, when the pressurized fuel is delivered into said first working chamber section through said first fuel passage, said second working chamber is communicated with the atmosphere through said third fuel passage as well as the pressurized fuel is delivered into said pumping chamber through said second fuel passage, and, when said first working chamber section is communicated with said injection nozzle through said fourth fuel passage, the pressurized fuel delivery into said first working chamber section through said first fuel passage is interrupted, and the communication between the second working chamber section and the atmosphere is also interrupted and said second working chamber is communicated with said pumping chamber.

2. A fuel pump for an internal combustion engine as claimed in claim 1, wherein said pumping means comprises a diametrical through bore formed in said rotor, a pair of plungers disposed slidably in said through bore in said rotor whereby said pumping chamber is defined by said through bore and said plungers, a pair of rollers each of which is disposed radially outwardly from said plunger and abuts at an outer periphery thereof upon said plunger, and an annular ring housing said rollers and having an inner surface on which a cam surface is provided, and wherein said plungers are moved towards and away from each other by means of said cam surface through said rollers, so that a volume of said pumping chamber is varied to pump the fuel contained in said pumping chamber into said second working chamber section.

3. A fuel pump for an internal combustion engine, the fuel pump comprising:

a main body having a bore therein;

a rotor housed within said bore and adapted to be rotated in synchronism with a rotation of said engine;

a working chamber formed in said rotor;

a shuttle member disposed slidably within said working chamber to divide said working chamber into a first and second working chamber section;

a pumping means having a pumping chamber, and, when a pressurized fuel is delivered into said first working chamber section through a first fuel passage in which a first metering means is disposed for metering said pressurized fuel, a pressurized fuel is delivered into said pumping chamber through a second fuel passage in which a second fuel metering means is disposed for metering said pressurized fuel, and said second working chamber section is communicated with an atmosphere through a third fuel passage, and, when the pressurized fuel delivery into said first working chamber section is stopped, and said first working chamber section is communicated with an injection nozzle through a fourth fuel passage, the pressurized fuel delivery into said pumping chamber is also stopped and then said pumping chamber is communicated with said second working chamber section through a fifth fuel passage;

said pumping means comprises a diametrical through bore formed in said rotor, a pair of plungers disposed slidably in said through bore in said rotor whereby said pumping chamber is defined by said through bore and said plungers, a pair of rollers each of which is disposed radially outwardly from said plunger and abut an outer periphery thereof upon said plunger, and an annular ring housing said rollers and having an inner surface on which a cam is provided, said plungers being adapted to move toward and away from each other by means of said cam surface through said rollers so that a volume of said pumping chamber is varied to pump a fuel contained in said pumping chamber into said second working chamber section;

wherein said first fuel passage includes a main passage section which extends from a main pumping means to an opening formed on a peripheral surface of said bore in said main body and a connecting passage section which opens at one end to said first working chamber section and at the other end to a portion of an outer periphery of said rotor adapted to be aligned with said opening of said main passage section, said second fuel passage includes a main passage section which extends from said main pumping means to an opening formed on said peripheral surface of said bore of said main body and a connecting passage section which opens at one end to said pumping chamber and at the other end to a portion of said outer periphery of said rotor adapted to be aligned with said opening of said main passage section of said second fuel passage, said third fuel passage includes a main passage section which extends from an opening formed on said peripheral surface of said bore in said main body to a reservoir and a connecting passage section which opens at one end to said second working chamber section and at the other end to a portion of said outer periphery of said rotor adapted to be aligned with said opening of said main passage section of said third fuel passage, said fourth fuel passage includes a main passage section which extends from an opening formed on said peripheral surface of said bore in said main body to said injection nozzle and a connecting passage section which opens at one end to said first working chamber section and at the other end to a portion of said outer periphery of said rotor adapted to be aligned with said opening of said main passage section of said fourth fuel passage, and said fifth fuel passage includes said connecting passage section of said second fuel passage, said connecting passage section of said third fuel passage and an interconnecting passage section for interconnecting between said connecting passage sections.

4. A fuel pump for an internal combustion engine as claimed in claim 3, wherein said fuel pumping apparatus further comprises a sensing means for sensing an alignment between said main passage section and said connecting passage section and for outputting a signal teaching such alignment, and a control unit for delivering, upon receipt of said signal from said sensing means, a command signal to said two metering means so as to operate metering means.

5. A fuel pump for an internal combustion engine as claimed in claim 4, wherein said two metering means respectively include solenoid valves.

6. A fuel pump for an internal combustion engine as claimed in either one of claims 3 or 4, wherein said first fuel passage, said second fuel passage and said third fuel passage have the respective connecting passage sections corresponding in number to the number of cylinders of said engine and which are respectively equiangularly spaced from one another in the said planes.

* * * * *